US009505142B2

(12) United States Patent
Nordstrom

(10) Patent No.: US 9,505,142 B2
(45) Date of Patent: Nov. 29, 2016

(54) MODULAR SAFETY RAZOR WITH ADJUSTABLE BLADE ANGLE

(71) Applicant: Rockwell Razors Corporation, Toronto (CA)

(72) Inventor: Morgan Nordstrom, Toronto (CA)

(73) Assignee: ROCKWELL RAZORS CORPORATION, Toronto, Ontario (CA)

( * ) Notice: Subject to any disclaimer, the term of this patent is extended or adjusted under 35 U.S.C. 154(b) by 141 days.

(21) Appl. No.: 14/484,330

(22) Filed: Sep. 12, 2014

(65) Prior Publication Data

US 2016/0075040 A1 Mar. 17, 2016

(51) Int. Cl.

| | |
|---|---|
| ***B26B 21/00*** | (2006.01) |
| ***B26B 21/18*** | (2006.01) |
| ***B26B 21/52*** | (2006.01) |

(52) U.S. Cl.

CPC ..... *B26B 21/18* (2013.01); *B26B 21/185* (2013.01); *B26B 21/521* (2013.01)

(58) Field of Classification Search

CPC .... B26B 21/18; B26B 21/185; B26B 21/521
USPC ..... 30/32, 532, 534
See application file for complete search history.

(56) References Cited

U.S. PATENT DOCUMENTS 1,071,970 A * 9/1913 Stutzman ..... B27G 13/04 144/225
1,496,295 A * 6/1924 Chance ..... B26B 21/18 30/71
1,765,805 A * 6/1930 Schlussler ..... B26B 21/18 30/41
1,815,745 A 7/1931 Thompson
1,923,439 A * 8/1933 Hukill ..... B26B 21/22 30/50
2,128,772 A 8/1938 Green
2,141,339 A * 12/1938 Bauerle ..... B26B 21/18 30/346.61
2,270,388 A * 1/1942 Stampleman ..... B26B 21/18 30/72
2,321,350 A 6/1943 Ardner (Continued)

FOREIGN PATENT DOCUMENTS

CA 799671 A 11/1968
CN 2710852 Y 7/2005

(Continued)

OTHER PUBLICATIONS

International Searching Authority, International Search Report and Written Opinion issued Nov. 27, 2015 in International Patent Application No. PCT/CA2015/000491.

(Continued)

*Primary Examiner* — Ghassem Alie
*Assistant Examiner* — Bharat C Patel
(74) *Attorney, Agent, or Firm* — Norton Rose Fulbright Canada LLP

(57) ABSTRACT

A safety razor for personal grooming is disclosed. The safety razor includes a handle, a cap, and a base plate that has blade-engaging surfaces that define the razor blade angle when clamped between the cap and the base plate. The base plate can be double-sided to provide a second angled blade-engaging surface that defines a second razor blade angle when the razor blade is clamped between the second side of the base plate and the cap. The modular base plate allows a shaver to replace or flip, in the case of double-sided base plates, the base plate in order to change the blade angle and the aggressiveness of the shave from the safety razor.

14 Claims, 4 Drawing Sheets

(56) References Cited

U.S. PATENT DOCUMENTS

| | | | | | |
|---|---|---|---|---|---|
| 2,333,894 | A | * | 11/1943 | Smith | B26B 21/18 30/41 |
| 2,342,161 | A | * | 2/1944 | Muros | B26B 21/18 30/64 |
| 2,472,807 | A | * | 6/1949 | Clark | B26B 21/18 30/70 |
| 2,567,811 | A | * | 9/1951 | Haushalter | B26B 21/185 30/534 |
| 2,573,980 | A | | 11/1951 | Mitchell | |
| 2,637,101 | A | | 5/1953 | Cutler | |
| 2,637,905 | A | * | 5/1953 | Williams | B26B 21/18 30/346.55 |
| 2,669,777 | A | * | 2/1954 | Scully | B26B 21/18 30/72 |
| 2,671,265 | A | | 3/1954 | Gavrilla et al. | |
| 2,705,834 | A | * | 4/1955 | Lundy | B26B 21/56 30/32 |
| D175,896 | S | | 10/1955 | Macmicking | |
| 2,794,246 | A | | 6/1957 | Marsh et al. | |
| 3,015,158 | A | | 1/1962 | Ayotte | |
| 3,079,685 | A | * | 3/1963 | Scully | B26B 21/185 30/346.61 |
| 3,088,206 | A | * | 5/1963 | Muros | B26B 21/185 30/60.5 |
| 3,129,508 | A | | 4/1964 | Dootson | |
| 3,413,720 | A | | 12/1968 | Mullen | |
| 3,583,262 | A | | 6/1971 | Mullen | |
| 3,626,591 | A | | 12/1971 | Robey | |
| 3,680,211 | A | * | 8/1972 | Keck | 30/41.5 |
| 3,748,735 | A | * | 7/1973 | Whittington | B26B 21/18 30/534 |
| 3,777,396 | A | | 12/1973 | Simonetti | |
| 3,889,370 | A | | 6/1975 | Hale, III | |
| 4,066,111 | A | * | 1/1978 | Klebe, Jr. | B27G 13/04 144/225 |
| 4,749,014 | A | * | 6/1988 | Schlund | B27G 13/04 144/117.4 |
| 5,363,892 | A | * | 11/1994 | Hild | B27G 13/04 144/117.4 |
| 7,100,649 | B2 | * | 9/2006 | Liu | B27G 13/04 144/117.1 |
| D763,506 | S | | 8/2016 | Barrett | |
| 2009/0007443 | A1 | | 1/2009 | Cuocolo, Jr. | |
| 2011/0197446 | A1 | | 8/2011 | Macove | |
| 2015/0298327 | A1 | | 10/2015 | Tomassetti et al. | |
| 2015/0352737 | A1 | | 12/2015 | Hickam | |
| 2016/0075040 | A1 | | 3/2016 | Nordstrom | |

FOREIGN PATENT DOCUMENTS

| | | | |
|---|---|---|---|
| DE | 2544425 | A1 | 4/1976 |
| DE | 202013005918 | U1 | 9/2013 |
| FR | 737509 | A | 12/1932 |
| GB | 193704 | A | 3/1923 |
| GB | 504986 | | 5/1939 |
| GB | 714122 | | 8/1954 |

OTHER PUBLICATIONS shaveinfo.com, "About Razor Blade Angles FAQ's", http://shaveinfo.com/shaving-information/blade-angle.htm, May 2015.

Maggard Razors Maggard Razors MR1 Knurled Stainless Steel Handle Safety Razor, http://www.maggardrazors.com/product/maggard-razors-mr1-chrome-safety-razor/, last accessed Jan. 5, 2016.

Muehle Shaving Culture, Product Section—Safety Razors, http://www.muehle-shaving.com/en/Product-world/Razors/, last accessed Jan. 5, 2016.

United States Patent and Trademark Office, Office Action issued in U.S. Appl. No. 29/539,215 dated Sep. 26, 2016.

* cited by examiner

MODULAR SAFETY RAZOR WITH ADJUSTABLE BLADE ANGLE

FIELD

The present disclosure relates generally to a safety razors used for personal grooming. More particularly, the disclosure relates to adjustment mechanisms for selecting the aggressiveness of the shave provided by the safety razor.

BACKGROUND

A safety razor is a shaving implement with a protective device positioned between the edge of the blade and the skin. The initial purpose of these protective devices was to reduce the level of skill needed for injury-free shaving, thereby reducing the reliance on professional barbers for providing that service and raising grooming standards.

The term safety razor was first used in U.S. Pat. No. 228,904 issued to Frederic and Otto Kampfe in 1880, for a razor in the basic contemporary configuration with a handle attached at right angles to a head in which a removable blade is placed.

Not much has changed in the innovation of the design of safety razors since King C. Gillette's U.S. Pat. No. 775,134 was issued in 1904. Gillette's innovation was a thin, cheap, double-edged blade that could be disposed of when dull. Gillette's blade holder clamped the blade between a backing and a guard plate that was then attached to a handle. The patented design also allowed for adjusting the gap between the blade and the guard plate to allow for light or heavy growth beards or to suit the skill or custom of the shaver.

The most popular modern shaving implement uses cartridge based razors that include a number of single-edged razors in a disposable cartridges. The consumer cost of these disposable cartridges is quite high and has been an impetus for the return to traditional wet shaving using double-edged safety razors. Refilling a traditional safety razor can cost under 10 cents whereas modern cartridges can cost well over $2 to replace. Today's modern razor cartridges can also irritate the skin more than needed due to the multiple blades.

The term "aggressiveness" is used with respect to traditional, non-cartridge based razors to refer to the subjective feeling and performance of the safety razor. Generally, more aggressive safety razors expose more of the razor blade to the skin and are suitable for a heavier beard as they will require less strokes. These more aggressive safety razors are also prone to more nicks, cuts and irritation, and require a more skilled hand. Less aggressive safety razors can be suitable for shorter stubble and beginners to safety razor shaving. Because a man's stubble can vary in length depending on the time from his last shave, it is desirable to have a safety razor that can provide different levels of aggressiveness.

The aggressiveness of a safety razor can be defined by a number of different factors, including, but not limited to, the exposure of the blade and the blade gap. The exposure of the blade is defined as the protrusion of the blade edge beyond a line tangent to the cap and the guard, and the blade gap is defined as the space between the blade edge and the guard. Other factors that can influence aggressiveness can include the weight of the razor head, overall razor weight balance between the handle and razor head, and the handle length.

Safety razor designs have often tried to provide some level of to adjust aggressiveness of the razor. Often, as in King C. Gillette's above patent, this is provided by some means to adjust the blade gap between the blade and the guard plate. Other examples of this type of adjustments include U.S. Pat. No. 284,880 to Schnitzler et al. and U.S. Pat. No. 2,700,817 to Erickson. Adjustment of the blade gap can allow for variance in stubble length but is only one factor affecting aggressiveness of a safety razor. Unintentionally changing the blade gap can change subjective aggressiveness of the safety razor significantly.

Blade angle is another factor that influences aggressiveness of a safety razor. The blade angle can be defined as the angle between the blade edge and a line tangent to the cap and guard. There is a preferable angle of about 30 degrees from the face, but this may vary based on the different beards, stubble length, skin type (i.e. likeliness of razor irritation), and even different areas of the same beard (e.g. neck versus face). Traditional double-edged safety razor designs typically have a fixed geometry for clamping the blade between the cap and guard plate that provides for a single static blade angle. Some single-edge razor designs have provided mechanical adjustment mechanisms that can be prone to failure or slippage, or that not translate to double-edged safety razors, such as that shown in U.S. Pat. No. 3,080,651 to La Cas.

SUMMARY

According to a first aspect, there is provided a safety razor comprising a handle, a cap having a central threaded stud to threadingly engage the handle, and a base plate defining a central aperture for receiving the central threaded stud therethrough. The base plate has a first side defining a first angled blade-engaging surface that defines a first blade angle when a safety razor blade is clamped between the cap and the first side of the base plate. In some aspects, the base plate can have a second side opposite the first side, the second side defining a second angled blade-engaging surface that defines a second blade angle when the safety razor is clamped between the cap and the second side of the base plate. In some aspects, the first angled blade-engaging surface and the second angled blade-engaging surface can each have separate surfaces on both sides of the central aperture to apply the first and second blade angle to each side of a double-edged razor blade. In yet other aspects, the first side and the second side of the base plate can each define a mating surface that abuts a top surface of the handle, the mating surface can be disposed below the angled blade-engaging surfaces. In a further aspect, the first angled blade-engaging surface and the second angled blade-engaging surface can each be interrupted by the corresponding mating surface. In yet another aspect, the cap can have a bullet post for aligning the safety razor blade and the base plate can have a corresponding alignment aperture for receiving the bullet post. In yet another aspect, the base plate can have a guard portion and the guard portion can define lather slots that correspond with an edge of the safety razor blade. In yet another aspect, the base plate can comprise a base portion having a guard portion and a modular aggressiveness defining portion that is replaceable and mates with the base portion to adjust aggressiveness of the safety razor.

According to a second aspect, there is provided a base plate for use in a modular safety razor, the base plate comprising a first side defining a first angled blade-engaging surface that defines a first blade angle when a safety razor blade is clamped between the cap and the first side of the base plate; and a second side opposite the first side, the second side defining a second angled blade-engaging surface that defines a second blade angle when the safety razor is clamped between the cap and the second side of the base plate.

According to yet another aspect, there is provided a modular safety razor shaving system that comprises a handle, a cap having a central threaded stud to threadingly engage the handle, and two or more base plates, each base plate defining a central aperture for receiving the central threaded stud therethrough, each base plate having a first side defining a first angled blade-engaging surface that defines a first blade angle when a safety razor blade is clamped between the cap and the first side of the base plate. In some aspects, the two or more base plates comprise a base portion and two or more modular aggressiveness defining portions, the base portion and modular aggressiveness defining portions have complementary mating surfaces and are held together by compression between the cap and the handle. In yet another aspect, the base plates can be double-sided, the base plate having a second side opposite the first side, the second side defining a second angled blade-engaging surface that defines a second blade angle when the safety razor is clamped between the cap and the second side of the base plate.

BRIEF DESCRIPTION OF THE DRAWINGS

For a better understanding of the various embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

It will be appreciated that for simplicity and clarity of illustration, where considered appropriate, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementations of various embodiments described herein.

Although some embodiments may explicitly refer to the double-edged safety razor shaving implements, it will be understood by those of ordinary skill in the art that teachings described herein can be applied to other shaving implements that have a similar cap and base plate structure. For example, and without limitation, devices that use a single edged blade can also be used to implement the embodiments described herein.

Term safety razor is used herein to refer to shaving implements for retaining a single user replaceable blade, and does not include cartridge-based razors or other disposable razors using multiple single edged blades.

Figure 1:
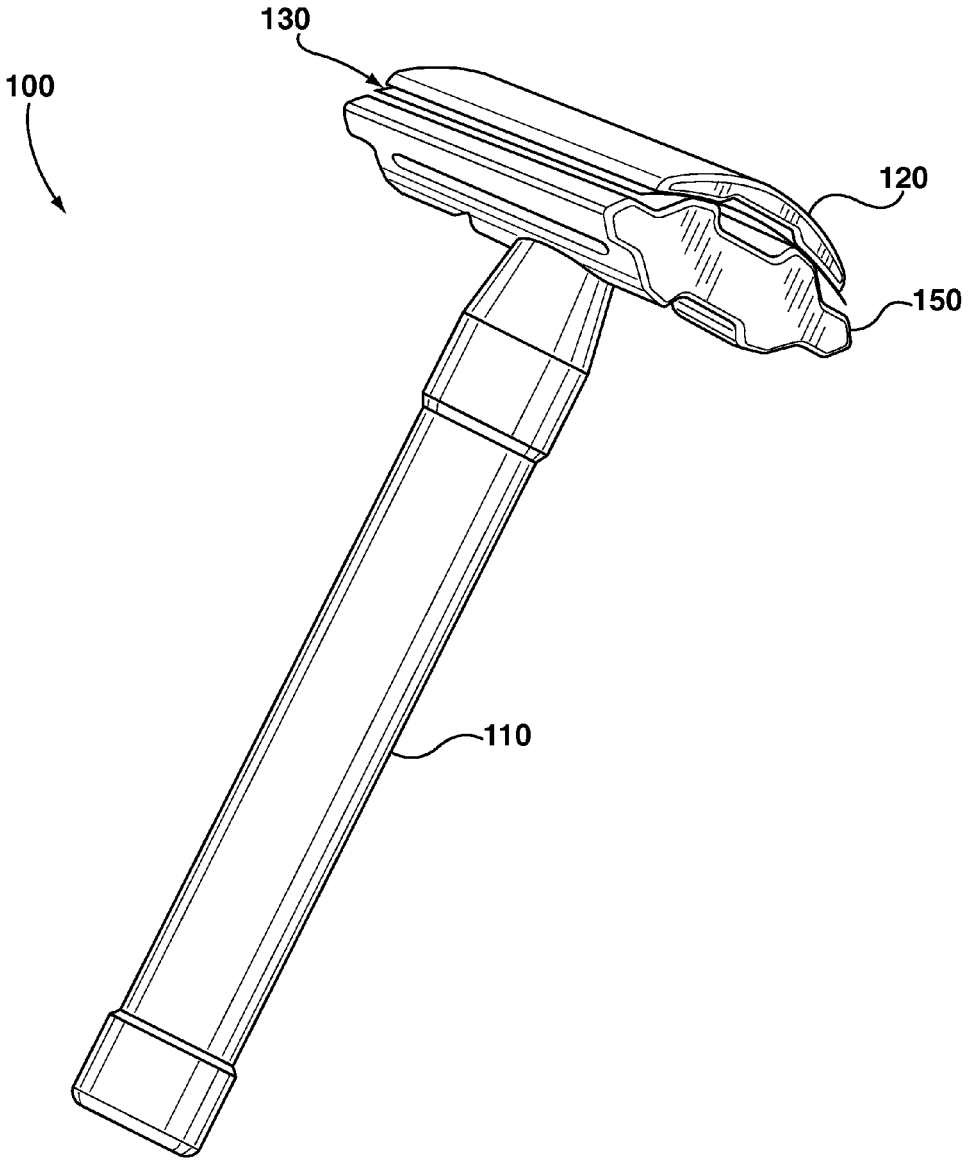
FIG. 1 is a perspective view of an embodiment of a safety razor having a handle, base plate and cap.
Figure 2:
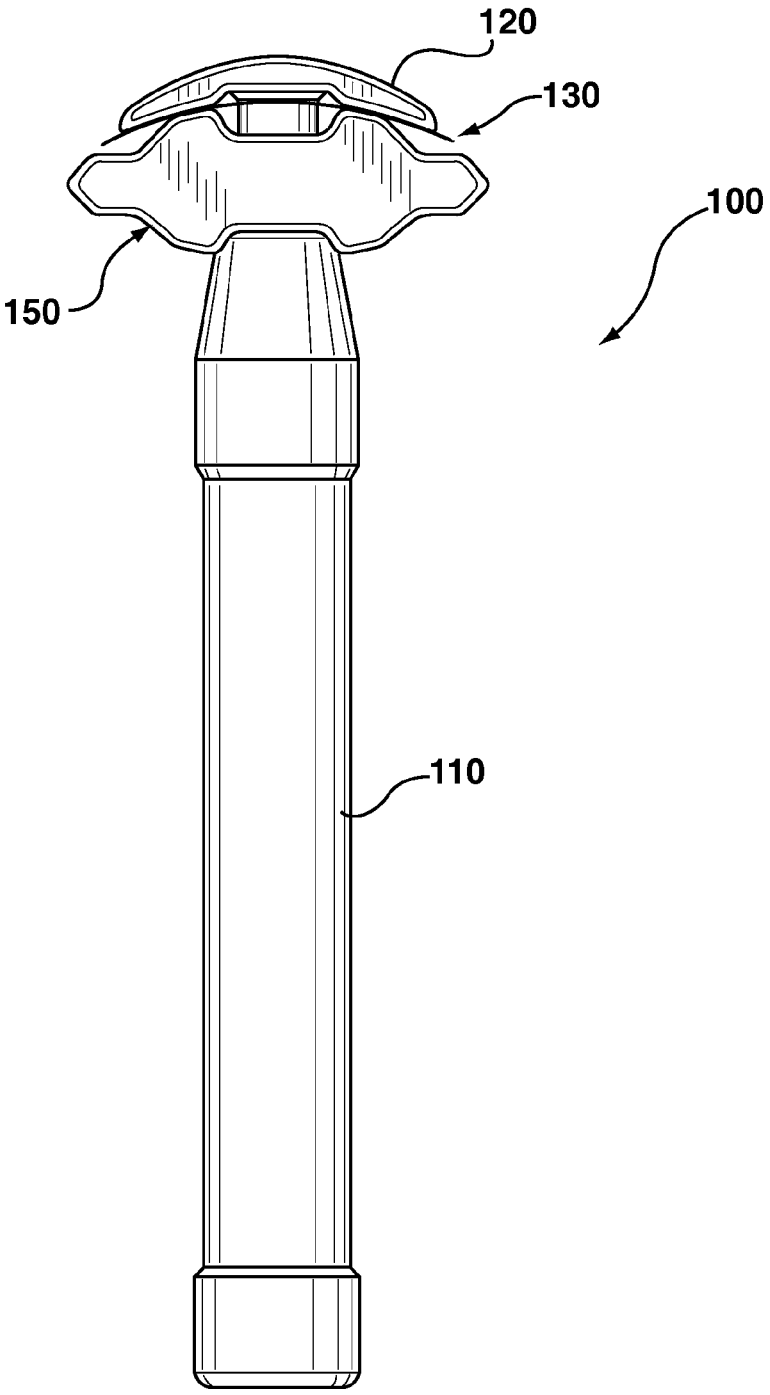
FIG. 2 is a side view of the safety razor shown in FIG. 1.

Referring first to FIGS. 1 and 2, shown are perspective view and side views of an embodiment of a safety razor 100 comprising a handle 110, a cap 120, and a base plate 150. Safety razor 100 is configured to hold a razor blade 130 clamped between cap 120 and base plate 150. Preferably, razor blade 130 is the commonly used double-edged razor blade and cap 120 and base plate 150 are symmetrical on either side of handle 110. Other embodiments can employ a singled-edged razor blade so long as cap 120 and base plate 150 are modified to clamp blade 130.

Figure 3:
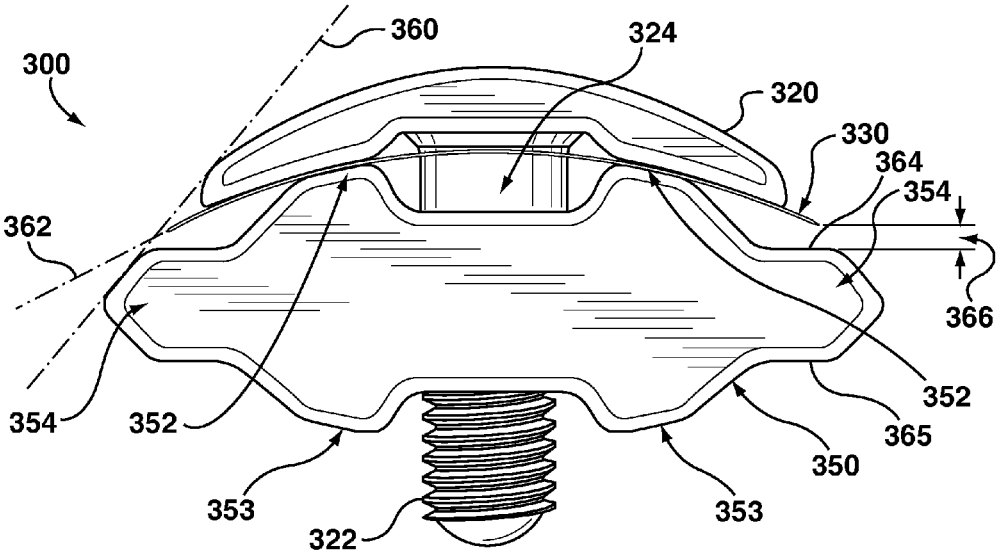
FIG. 3 is a side view of a cap and a base plate of an embodiment of a safety razor holding a double-edged safety razor.
Figure 4:
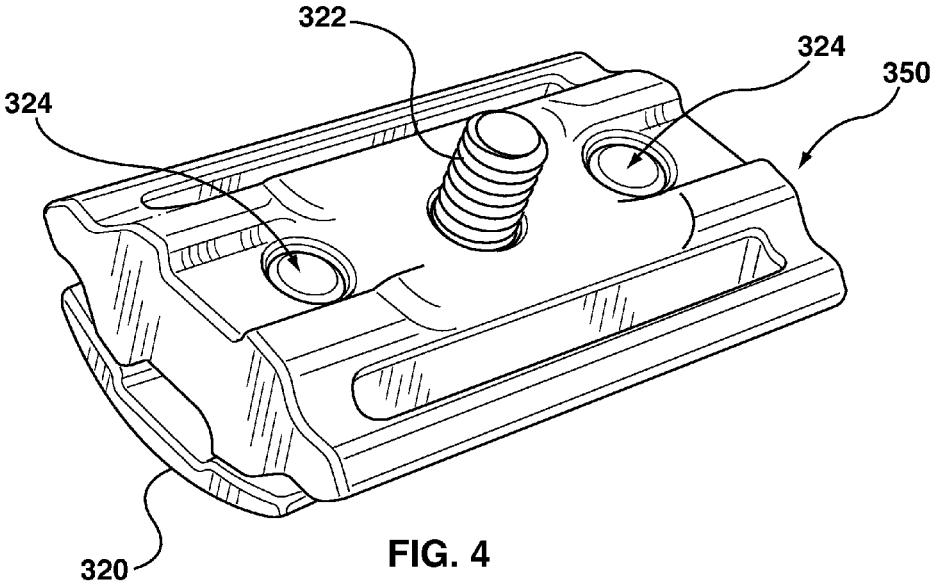
FIG. 4 is a bottom perspective view of the embodiment shown in FIG. 3.

Referring now to FIGS. 3 and 4, shown are a side view and perspective view of a cap 320 and base plate 350 assembly 300 for use with a safety razor. Cap 320 can have a central threaded stud 322 to threadingly engage a handle, such as handle 110 shown in FIGS. 1 and 2. Other embodiments can have a threaded stud at the end of the handle and the central stud 322 of cap 320 can be configured to threadingly engage the threaded stud of the handle. Base plate 350 can define a central aperture 351 for receiving the threaded stud therethrough.

Cap 320 can have at least one bullet post 324 that projects from the bottom surface of cap 320. Bullet post 324 are useful to aid in alignment of razor blade 330 which includes apertures to receive bullet posts 324 and central threaded stud 322. Similarly, base plate 350 defines central aperture 351 to allow central threaded stud to pass through to mate with a handle, such as handle 110, and base plate 350 further defines alignment aperture 355 that correspond with one or more bullet posts 324 of cap 320.

When a handle is screwed onto the cap and base plate assembly 300, pressure is applied to razor blade 330 positioned between cap 320 and base plate 350. This compression force causes razor blade 330 to conform to a blade-engaging surface 352 of base plate 350 to cause razor blade 330 to flex. The bottom surface of cap 320 provides concave surfaces to allow razor blade 330 to bend to provide a downward angle.

Blade-engaging surface 352 defines the blade angle of razor blade 330, and thus in part, defines the aggressiveness of the shave of the safety razor. The blade angle is defined relative to a line that would lie planar with the face when shaving that is illustrated by dotted line 360 and line 362 that is tangential to razor blade 330 near its end. The planar face line is formed between the edges cap 320 and the outer edge of guard portion 354 of base plate 350 that make contact with the face when shaving.

The height of blade-engaging surface 352 above the surface 364 of guard portion 354 also defines a blade gap 366 of the safety razor. Blade gap 366 is the gap between the blade and surface 364 of guard portion 354 to allow for light or heavy growth beards or to suit the skill or custom of the shaver. Blade gap 366 is also a factor that defines the aggressiveness of base plate 350.

Base plate 350 can be single-sided or double-sided. A double-sided embodiment in shown in FIGS. 3-4 that provides for different blade angles depending upon which side (i.e. top or bottom in FIGS. 3 and 4) of base plate 350 clamps razor blade 330. A single-sided embodiment, such as that shown in FIG. 5, can have a second side that is mainly planar and opposite the side having the blade-engaging surfaces.

Figure 6:
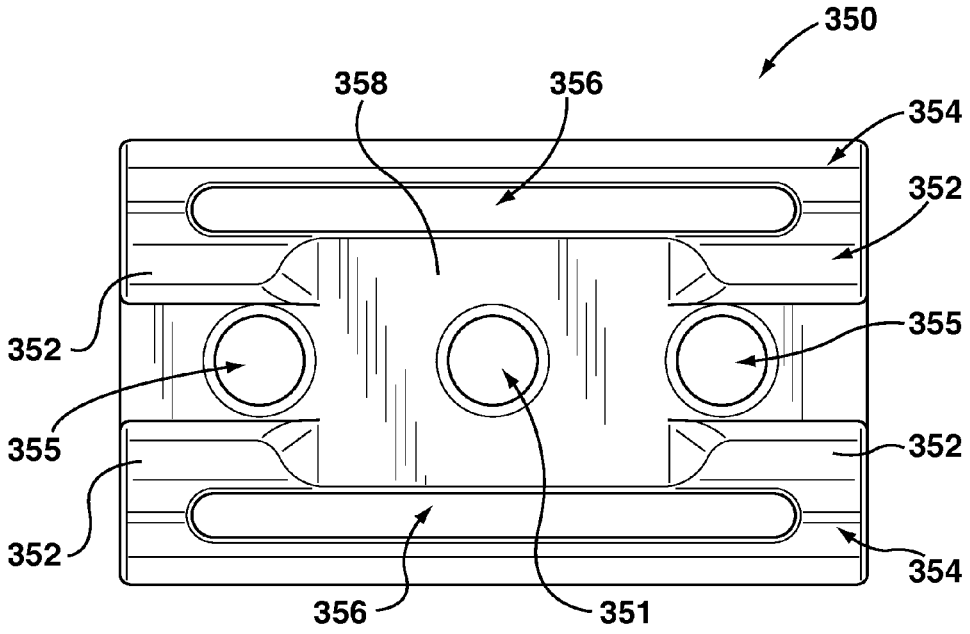
FIG. 6 is a top plan view of the base plate of the embodiment shown in FIGS. 3 and 4.

Double-sided base plate 350 has a second side opposite the first side, the second side also having a second blade-engaging surface 353 that define a second blade angle when razor blade 330 is clamped between cap 320 and the second blade-engaging surfaces 353 of the second side of base plate 350. This allows a single base plate to provide two different blade angles to allow a user of the safety razor to select their desired level of aggressiveness by selecting which side of base plate 350 is compressed against razor blade 330. As illustrated in FIGS. 4 and 6, the surface of each side of base plate 350 can include markings that indicate its level of aggressiveness, for example, by using a numbered scale to indicate a level of aggressiveness.

In some embodiments, each side of base plate 350 can provide a different blade gap 366. Blade-engaging surfaces 352 and 353 can each have a different height above the corresponding surface 364 and 365, respectively, of guard portion 354 that provides for differing blade gaps for each side of base plate 350.

First angled blade-engaging surface 352 and second angled blade-engaging surface 353 can have two separate surfaces on either side of the central stud aperture to allow for double-edged safety razors to be used. This allows the separate surfaces on both sides of the central aperture to apply the first and second blade angle to each side of a double-edged razor blade.

Base plate 350 is preferably symmetrical between the left and right sides as shown in FIG. 3. This allows a shaver to use one side of the safety razor until it is full of shaving cream, then flip the safety razor over to shave with the other side and then rinse out the safety razor for another pass. Other embodiments can have a non-symmetrical base plate that allows for a different level of aggressiveness on either side, or a different guard portion 354, such as, for example, providing a different blade gap or different guard style (e.g. open comb v.s. guard bar).

A modular safety razor system can comprise a cap, a handle and a number of differing base plates. Each of the base plates can differ by providing a different blade angle that is imparted to the razor blade by the blade engaging surface of the base plate. This allows the user of the modular safety razor system to select their preferred base plate when attaching their razor blade to select the aggressiveness of their shave. A modular safety razor system can use either double-sided base plates, such as that shown in FIGS. 1-4, or a single-sided base plate, such as that shown in FIG. 5. Double-sided base plates are preferable as they can provide two differing levels of aggressiveness in a single-sided base plate.

Figure 5:
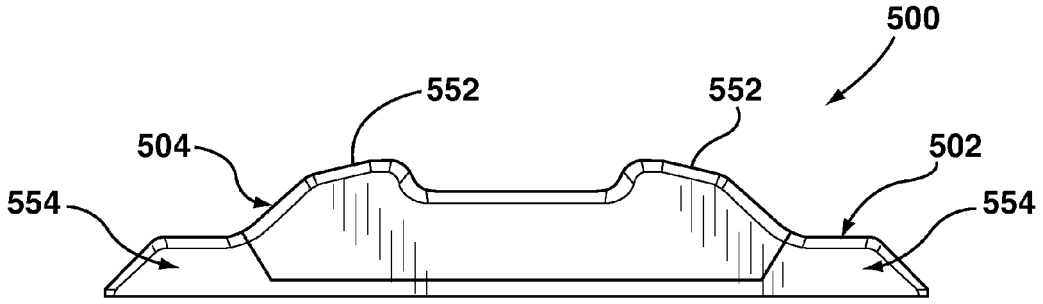
FIG. 5 is a side view of an embodiment of a modular base plate for use in a 3-piece cap and base plate assembly safety razor.

Referring now to FIG. 5, shown is a side view of an embodiment of a modular base plate 500 for use in a 3-piece cap and base plate assembly safety razor. Modular base plate 500 has a base portion 502 and a modular aggressiveness defining portion 504. Base portion 504 has a guard portion 554 that provides that guard bar function and can also include lather slots. Portion 504 can be swapped with other portions that provide differing levels of aggressiveness to allow adjustment of the aggressiveness of the safety razor. Portion 504 and base portion 502 have complementary mating surfaces and are held together by compression between the cap and the handle. Each differing aggressiveness defining portion 504 can provide a different blade-engaging surface 552 that defines the blade angle of a razor blade. Each differing aggressiveness defining portion 504 can also provide a differing blade gap by having blade-engaging surface 552 a different displacement above planar portion of base portion 502. A modular safety razor system can comprise a cap, a handle, a base plate having a base portion 502, and a number of differing modular aggressiveness defining portions 504.

Referring now to FIG. 6, shown is a top plan view of base plate of the embodiment shown in FIGS. 3 and 4. Guard portions 354 define lather slots 356 to allow lather to pass through to avoid blocking the exposure of the razor blade when shaving. Lather slots 356 preferably correspond with the edge of razor blade 330 to allow lather and cut stubble to move through the blade gap and into lather slots 356.

FIG. 6 also illustrates mating surface 358 of base plate 350. Preferably, mating surface 358 is planar and abuts the planar surface at the top of handle 110. A double-sided base plate would also have an opposing mating surface on the opposite side to allow the double-sided base plate to be flipped.

In some embodiments, mating surface 358 can interrupt angled blade-engaging surfaces 352. The curvature applied to razor blade 330 by base plate 350 and cap 320 provide rigidity and stability to razor blade 330 such that angled blade-engaging surfaces 352 do not need run the full length of base plate 350. This interruption and larger mating surface 358 allows handles with a larger top surface to mate with base plate 350. Mating surface 358 is disposed below angled blade-engaging surfaces as to not interfere with razor blade 330 when base plate 350 is flipped (i.e. when the opposing mating surface is abutting handle 110).

While the exemplary embodiments have been described herein, it is to be understood that the invention is not limited to the disclosed embodiments. The invention is intended to cover various modifications and equivalent arrangements included within the spirit and scope of the appended claims, and scope of the claims is to be accorded an interpretation that encompasses all such modifications and equivalent structures and functions.

The invention claimed is:

1. A safety razor comprising:

a handle;

a cap having a central threaded stud to threadingly engage the handle; and a base plate defining a central aperture for receiving the central threaded stud therethrough, the base plate having a first side defining a first angled blade-engaging surface and a second side opposite the first side, the second side defining a second angled blade-engaging surface;

the base plate configured for securing a double-edged safety razor blade when the base plate is positioned in a first position, or when the base plate is positioned in a second position;

wherein in the first position, the safety razor blade is clamped between the cap and the first side of the base plate, the second side faces in a direction of the handle, and the first angled blade-engaging surface defines an angle of the safety razor blade; and in the second position, the safety razor blade is clamped between the cap and the second side of the base plate, the first side faces in the direction of the handle, and the second angled blade-engaging surface defines the angle of the safety razor blade; and wherein the first angled blade-engaging surface and the second angled blade-engaging surface each have separate surfaces on both sides of the central aperture to apply the first and second blade angle to each side of the safety razor blade.

2. The safety razor of claim 1, wherein the angle of the safety razor blade defined by the first angled blade-engaging surface is different than the angle of the safety razor blade defined by the second angled blade-engaging surface.

3. The safety razor of claim 1, wherein the first side and the second side of the base plate each define a mating surface for abutting a top surface of the handle, the mating surface disposed below the angled blade-engaging surfaces.

4. The safety razor of claim 3, wherein the first angled blade-engaging surface and the second angled blade-engaging surface are each interrupted by the corresponding mating surface.

5. The safety razor of claim 1, wherein the cap has at least one bullet post for aligning the safety razor blade and the base plate has at least one corresponding alignment aperture for receiving the at least one bullet post.

6. The safety razor of claim 1, wherein the base plate has a guard portion.

7. The safety razor of claim 6, wherein the guard portion defines lather slots that correspond with an edge of the safety razor blade.

8. The safety razor of claim 1, wherein the base plate comprises a base portion having a guard portion and a modular aggressiveness defining portion that is replaceable to adjust aggressiveness of the safety razor.

9. A base plate for use in a modular safety razor, the base plate comprising:

a first side defining a first angled blade-engaging surface; and a second side opposite the first side, the second side defining a second angled blade-engaging surface the base plate configured for securing a double-edged safety razor blade when the base plate is positioned in a first position, or when the base plate is positioned in a second position;

wherein in the first position, the safety razor blade is clamped between a cap and the first side of the base plate, the second side faces in a direction away from the cap, and the first angled blade-engaging surface defines an angle of the safety razor blade; and in the second position, the safety razor blade is clamped between the cap and the second side of the base plate, the second side faces in the direction away from the cap, and the second angled blade-engaging surface defines the angle of the safety razor blade; and wherein the first angled blade-engaging surface and the second angled blade-engaging surface each have separate surfaces on both sides of the central aperture to apply the first and second blade angle to each side of the safety razor blade.

10. The base plate of claim 9, wherein the angle of the safety razor blade defined by the first angled blade-engaging surface is different than the angle of the safety razor blade defined by the second angled blade-engaging surface.

11. A modular safety razor shaving system, the system comprising:

a handle;

a cap having a central threaded stud to threadingly engage the handle; and two or more base plates, each base plate defining a central aperture for receiving the central threaded stud therethrough, each base plate having a first side defining a first angled blade-engaging surface that defines a first blade angle when a double-edged safety razor blade is clamped between the cap and the first side of the base plate; at least one of the two or more base plates being double-sided, the at least one double-sided base plate having a second side opposite the first side, the second side defining a second angled blade-engaging surface; the at least one double-sided base plate configured for securing the safety razor blade when the at least one double-sided base plate is positioned in a first position, or when the at least one double-sided base plate is positioned in a second position;

wherein in the first position, the safety razor blade is clamped between the cap and the first side of the base plate, the second side faces in a direction of the handle, and the first angled blade-engaging surface defines the angle of the safety razor blade; and in the second position, the safety razor blade is clamped between the cap and the second side of the base plate, the first side faces in the direction of the handle, and the second angled blade-engaging surface defines the angle of the safety razor blade; and wherein the first angled blade-engaging surface and the second angled blade-engaging surface each have separate surfaces on both sides of the central aperture to apply the first and second blade angle to each side of the safety razor blade.

12. The modular safety razor shaving system of claim 11, wherein the two or more base plates comprise a base portion and two or more modular aggressiveness defining portions, the base portion and modular aggressiveness defining portions have complementary mating surfaces and are held together by compression between the cap and the handle.

13. The modular safety razor shaving system of claim 11, wherein the base plates are double-sided, the base plate having a second side opposite the first side, the second side defining a second angled blade-engaging surface that defines a second blade angle when the safety razor blade is clamped between the cap and the second side of the base plate.

14. The modular safety razor shaving system of claim 11, wherein the angle of the safety razor blade defined by the first angled blade-engaging surface is different than the angle of the safety razor blade defined by the second angled blade-engaging surface.

* * * * *